US010347163B1

(12) United States Patent
Herf et al.

(10) Patent No.: US 10,347,163 B1
(45) Date of Patent: Jul. 9, 2019

(54) ADAPTIVE COLOR IN ILLUMINATIVE DEVICES

(75) Inventors: Michael Herf, Los Angeles, CA (US); Lorna Herf, Los Angeles, CA (US)

(73) Assignee: F.lux Software LLC, Los Angelos, CA (US)

( * ) Notice: Subject to any disclaimer, the term of this patent is extended or adjusted under 35 U.S.C. 154(b) by 1749 days.

(21) Appl. No.: 12/455,529

(22) Filed: Jun. 3, 2009

Related U.S. Application Data

(60) Provisional application No. 61/199,162, filed on Nov. 13, 2008.

(51) Int. Cl.
*G09G 3/20* (2006.01)

(52) U.S. Cl.
CPC ... *G09G 3/2003* (2013.01); *G09G 2320/0666* (2013.01); *G09G 2320/08* (2013.01)

(58) Field of Classification Search
USPC ..... 345/207, 690, 55
See application file for complete search history.

(56) References Cited

U.S. PATENT DOCUMENTS

| | | | | |
|---|---|---|---|---|
| 5,874,988 | A | 2/1999 | Gu | |
| 6,600,833 | B1 * | 7/2003 | Tan | H04N 1/6033 348/612 |
| 6,870,529 | B1 | 3/2005 | Davis | |
| 7,446,762 | B2 | 11/2008 | Hsieh et al. | |
| 7,840,067 | B2 | 11/2010 | Shen et al. | |
| 8,188,990 | B2 | 5/2012 | Zamorsky et al. | |
| 8,384,780 | B1 * | 2/2013 | Frank et al. | 348/148 |
| 8,648,691 | B2 | 2/2014 | Zuo et al. | |
| 9,039,199 | B2 | 5/2015 | Asakawa | |
| 2002/0008696 | A1 | 1/2002 | Wagner | |
| 2004/0165001 | A1 * | 8/2004 | Wang | 345/690 |

(Continued)

FOREIGN PATENT DOCUMENTS

| | | |
|---|---|---|
| EP | 1619648 | 1/2006 |
| WO | WO 2011089540 | 7/2011 |
| WO | WO 2016033099 | 3/2016 |

OTHER PUBLICATIONS

What color is a blackbody?—some pixel rgb values; Charity; http://www.vendian.org/mncharity/dir3/blackbody/; Jun. 2001; Jun. 4, 2013; 3 pages.

(Continued)

*Primary Examiner* — William Boddie
(74) *Attorney, Agent, or Firm* — Fish & Richardson P.C.

(57) ABSTRACT

The invention provides a system for dynamically adjusting displays, particularly displays associated with electronic devices such as computers. The system provides for manual and automatic adjustment of displays, and adjustment of signals to displays, where such adjustments are made in consideration of the environment in which the display is viewed. In one embodiment the inventive system uses at least one sensor to monitor some environment condition and adjusts display color relative to sensor input. In a preferred embodiment, the system provides automatic display adjustments so that display colors adjust according to time of day, becoming warmer after dark, to simulate indoor lighting, and cooler ("sunlight-like") during the day, to match sunlight as perceived by a human viewer. Advantages of the invention include reduction of eye-strain as well as task-specific accommodations.

21 Claims, 2 Drawing Sheets

(56) References Cited

U.S. PATENT DOCUMENTS

| | | | | |
|---|---|---|---|---|
| 2004/0225340 | A1* | 11/2004 | Evans | A61M 21/00 607/88 |
| 2005/0134547 | A1* | 6/2005 | Wyatt | 345/102 |
| 2006/0069794 | A1* | 3/2006 | Gorog | G09G 1/285 709/231 |
| 2006/0152525 | A1 | 7/2006 | Woog | |
| 2007/0239837 | A1* | 10/2007 | Jablokov et al. | 709/206 |
| 2007/0289182 | A1* | 12/2007 | Reinold et al. | 40/594 |
| 2008/0033633 | A1* | 2/2008 | Akiyoshi et al. | 701/201 |
| 2009/0016168 | A1* | 1/2009 | Smith | 368/10 |
| 2010/0118403 | A1* | 5/2010 | Laitinen et al. | 359/567 |
| 2010/0277076 | A1* | 11/2010 | Tracy et al. | 315/149 |

OTHER PUBLICATIONS

Mantiuk et al; Display Adaptive Tone Mapping; ACM Transactions on Graphics (Proc. of SIGGRAPH '08); 2008; 27 (3), article No. 68, 10 pages.

Mantiuk et al; Display Adaptive Tone Mapping—Supplementary Materials; ACM Transactions on Graphics (Proc. of SIGGRAPH '08); 2008; 3 pages.

Bakalar, "How E-books may disrupt your sleep," well.blogs.nytimes.com [online] Dec. 22, 2014 [retrieved Dec. 22, 2014]. Retrieved from the Internet: <URL: http://well.blogs.nytimes.com/2014/12/22/e-books-may-interfere-with-sleep/?_r=1>, 2 pages.

Chang et al., "Evening use of light-emitting eReaders negatively affects sleep, circadian timing, and next-morning alertness," Proc Natl Acad Sci U S A., pii: 201418490, Epub Dec. 22, 2014.

Falbe et al., "Sleep duration, restfulness, and screens in the sleep environment," Pediatrics, pii: peds.2014-2306, Epub. Jan 5, 2015.

Searing, "Sleep troubles? Maybe electronic devices are interfering with bedtime," washingtonpost.com [online] Jan. 5, 2015 [retrieved on Jan. 7, 2015]. Retrieved from the Internet: <URL: http://www.washingtonpost.com/national/health-science/sleep-troubles-maybe-electronic-devices-are-interfering-with-bedtime/2015/01/05/0ca0ebd8-905e-11e4-ba53-a477d66580ed_story.html>, 4 pages.

Vanhemert, "The UI inventions we want to see in 2015," wired.com [online] Jan. 6, 2015 [retrieved on Jan. 7, 2015]. Retrieved from the Internet: <URL: http://www.wired.com/2015/01/ui-inventions-want-see-2015/?mbid=social_twitter>, 5 pages.

"Can color temperature affect my mood?" Westinghouse Lighting [online] retrieved on Mar. 28, 2016. Retrieved from the Internet: <URL: http://www.westinghouselighting.com/color-tempemture.aspx>, 3 pages.

"Color Correction definition," Creative Glossary [online] retrieved on Mar. 28, 2016. Retrieved from the Internet: <URL: http://www.creativeglossary.com/digital-fine-art-print-making/color-correction.html>, 1 page.

"Color correction," Wikipedia [online] Dec. 19, 2015 [retrieved on Mar. 28, 2016]. Retrieved from the Internet: <URL: https://en.wikipedia.org/wiki/Color_correction>, 3 pages.

"Color temperature," Webopedia [online] retrieved on Mar. 28, 2016. Retrieved from the Internet: <URL: http://www.webopedia.com/TERM/C/color_temperature.html>, 2 pages.

"Color temperature," Wikipedia [online] Mar. 12, 2016 [retrieved Mar. 28, 2016]. Retrieved from the Internet: <URL: https://en.wikipedia.org/wiki/Color_temperature>, 16 pages.

"F.lux Review," My Morning Routine [online] Dec. 22, 2014 [retrieved on Mar. 28, 2016]. Retrieved from the Internet: <URL: http://mymorningroutine.com/flux-review/>, 2 pages.

"F.lux," Product Hunt [online] Jan. 6, 2014 [retrieved Mar. 28, 2016]. Retrieved from the Internet: <URL: https://www.producthunt.com/tech/f-lux>, 3 pages.

"Light-emitting e-readers before bedtime can adversely impact sleep." Brigham and Women's Hospital [online] Dec. 22, 2014 [retrieved on Mar. 28, 2016]. Retrieved from the Internet: <URL: http://www.brighamandwomens.org/about_bwh/publicaffairs/news/pressreleases/PressRelease.aspx?PageID=1962 >2 pages.

"Tungsten film," Wikipedia [online] Feb. 24, 2013 [retrieved on Mar. 28, 2016]. Retrieved from the Internet: <URL: https://en.wikipedia.org/wiki/Tungsten_film>, 1 page.

"Wratten number," Wikipedia [online] Jun. 24, 2015 [retrieved on Mar. 28, 2016]. Retrieved from the Internet: <URL: https://en.wikipedia.org/wiki/Wratten_number>, 7 pages.

Beil, "In Eyes, a Clock Calibrated by Wavelengths of Light," The New York Times [online] Jul. 4, 2011 [retrieved on Mar. 28, 2016]. Retrieved from the Internet: <URL: http://www.nytimes.com/2011/07/05/health/05light.html?_r=0>, 5 pages.

Braga, "The Story Behind f.lux, the Night Owl's Color-Shifting Sleep App of Choice," Motherboard [online] Jan. 21, 2016 [retrieved on Mar. 28, 2016]. Retrieved from the Internet: <URL: http://motherboard.vice.com/read/the-story-behind-flux-the-night-owls-color-shifting-sleep-app-of-choice>, 11 pages.

Chang et al., "Evening use of light-emitting eReaders negatively affects sleep, circadian timing, and next-morning alertness," *Proc Natl Acad Sci U S A.*, 112(4):1232-1237, Epub Dec. 22, 2014.

Gooley et al., "Exposure to room light before bedtime suppresses melatonin onset and shortens melatonin duration in humans," *J Clin Endocrinol Metab.*, 96(3):E463-E472, Epub Dec. 30, 2010.

Hoebee, "F.lux: the favorite application on my PC," Dick Hoebee [online] Jul. 14, 2015 [retrieved on Mar. 28, 2016]. Retrieved from the Internet: <URL: http://dickhoebee.com/2015/07/flux/>, 4 pages.

Holzman, "What's in a color? The unique human health effect of blue light," *Environ Health Perspect.*, 118(1):A22-A27, Jan. 2010.

Inhofer, "Color Grading vs. Color Correction: What's the Difference?" Lynda [online] Jul. 2, 2015 [retrieved on Mar. 28, 2016]. Retrieved from the Internet: <URL: http://www.lynda.com/articles/color-grading-vs-color-correction>, 5 pages.

Jragar, "Take Back Your Sleep Pattern: f.lux Review," GMR tec [online] Feb. 8, 2016 [retrieved on Mar. 28, 2016]. Retrieved from the Internet: <URL: http://www.gmrtec.com/index.php/2016/02/08/take-back-your-sleep-pattern-f-lux-review/>, 9 pages.

Kim, "Blue light from electronics disturbs sleep, especially for teenagers," The Washington Post [online] Sep. 1, 2014 [retrieved on Mar. 28, 2016]. Retrieved from the Internet: URL: https://www.washingtonpost.com/national/health-science/blue-light-from-electronics-disturbs-sleep-especially-for-teenagers/2014/08/29/3edd2726-27a7-11e4-958c-268a320a60ce_story.html>, 4 pages.

Mann, "F.lux Review: The Software That Makes You Sleep Better," Sleep Junkies [online] Dec. 4, 2012 [retrieved on Mar. 28, 2016]. Retrieved from the Internet: URL: http://sleepjunkies.com/tools/flux-app-review/, 13 pages.

Pash, "F.lux Changes Your Screen Brightness by Time of Day," Lifehacker [online] Feb. 23, 2009 [retrieved on Mar. 28, 2016]. Retrieved from the Internet: <URL: http://lifehacker.com/5158832/flux-changes-your-screen-brightness-by-time-of-day>, 2 pages.

Robinson, "This app has transformed my nighttime computer use," Tech Insider [online] Oct. 28, 2015 [retrieved on Mar. 25, 2016]. Retrieved from the Internet: <URL: http://www.techinsider.io/flux-review-2015-10>, 6 pages.

Schifreen, "A Reminder: If You Use Windows, Just Get Flux," Gizmo's Freeware [online] Jan. 13, 2015, [retrieved on Mar. 25, 2016]. Retrieved from the Internet: <URL: http://www.techsupportalert.com/content/reminder-if-you-use-windows-just-get-flux.htm>, 6 pages.

Smith, "This free app makes reading a computer screen at night much easier," Business Insider [online] Mar. 25, 2013 [retrieved on Mar. 28, 2016]. Retrieved from the Internet: <URL: http://www.businessinsider.com/flux-software-helps-ease-your-eyes-2013-3>, 3 pages.

The Lifehacker Staff, "The 50 Free Apps We're Most Thankful for," Lifehacker [online] Nov. 16, 2015 [retrieved on Mar. 28, 2016]. Retrieved from the Internet: <URL: http://lifehacker.com/5962588/the-50-free-apps-were-most-thankful-for>, 35 pages.

Turnbull, "50 Mac Essentials #13: Flux," Cult of Mac [online] Sep. 20, 2010 [retrieved on Mar. 25, 2016]. Retrieved from the Internet: <URL: http://www.cultofmac.com/59821/50-mac-essentials-13-flux/>, 15 pages.

Wernick, "Losing sleep? Blame your favorite electronic device," Public Radio International [online] Jan. 27, 2015 [retrieved Mar. 28,

(56) References Cited

OTHER PUBLICATIONS

2016]. Retrieved from the Internet: <URL: http://www.pri.org/stories/2015-01-27/losing-sleep-blame-your-favorite-electronic-device>, 7 pages.
Wikipedia, "f.lux," Wikipedia [online] Mar. 11, 2016 [retrieved on Mar. 25, 2016]. Retrieved from the Internet: <URL: https://en.wikipedia.org/wiki/F.lux>, 3 pages.
Woods, "F.lux finally comes to Android to save your eyes," The Next Web [online] Mar. 15, 2016 [retrieved on Mar. 28, 2016]. Retrieved from the Internet: <URL: http://thenextweb.com/apps/2016/03/15/f-lux-automatically-controls-androids-screen-reduce-strain-eyes/%20-%20gref/>, 4 pages.
Yurek, "Apple CEO Tim Cook talks color quality at Goldman Sachs conference," Nanosys [online] Feb. 13, 2013 [retrieved on Mar. 28, 2016]. Retrieved from the Internet: <URL: http://www.nanosysinc.com/dot-color-archive/2013/02/13/apple-ceo-tim-cook-talks-color-quality-at-goldman-sachs-conference> 4 pages.
Zukerman, "Review: f.lux makes your computer usable at night," PC World [online] Oct. 31, 2013 [retrieved on Mar. 28, 2016]. Retrieved from the Internet: <URL: http://www.pcworld.com/article/2056895/review-f-lux-makes-your-computer-usable-at-night.html>, 8 pages.

* cited by examiner

24

ADAPTIVE COLOR IN ILLUMINATIVE DEVICES

RELATED APPLICATIONS

This application is related to and claims priority from U.S. provisional application 61/199,162, filed Nov. 13, 2008, the entirety of which is incorporated herein by reference.

GOVERNMENT FUNDING

None

FIELD OF USE

The invention is useful in the field of display devices, and in particular display devices connectable to a hardware system. More particularly, the invention relates to automatic adjustments in illumination and color characteristics based on observed inputs, especially when inputs vary over time.

BACKGROUND

Most display technologies today display colors calibrated for a single, fixed environment. For example, many displays today are designed to show colors that look correct under the D65 illuminant using the sRGB color system, which approximates the colors found in daylight. After dark, our homes are lit by much warmer light, and device displays, including computers, cell phones, and other devices do not adapt to this change, making their displays look "blue" when viewed in dark rooms.

Recent studies report that in the United States, adults 45-55 years of age spent over nine hours a day viewing a screen (i.e. electronic visual display) of some kind. Computer screens and displays represent a large portion of total viewing time. Thus, the quality of the screen viewing experience is important from health and aesthetic standpoints. An important aspect of screen viewing experience is color quality. It can be appreciated that the entire screen is what impacts the viewer, and adjustments to the entire screen are needed to adjust color quality.

Currently color correction is generally limited to particular static environments, such as, for example, digital display calibration [ex. ICC-1931: ICM/WCS and in particular applications such as Photoshop, which implement digital color management using a combination of software and hardware].

The aesthetics of interior design have motivated creation of products to alter room lighting over time. See, for example, architectural lighting products from companies such as Philips Solid-State Lighting Solutions, formerly Color Kinetics. Certain interior room lighting may be manually adjusted for aesthetics (e.g., Herman Miller's Leaf Light). Electronic displays for personal computing, for example, are prominent features in working and living space. However, illumination sources such as emissions from computer monitors and other display type light sources have not been integrated into aesthetic design plans. Moreover, existing consumer products featuring variable lighting illumination are limited, offering a few settings corresponding to pre-determined illuminations. No such devices provide the ability to modify illumination either manually or automatically as a function of real-time environmental characteristics.

Some attempts have been made to optimize viewing of, for example, television screens. However, such adaptations mainly involve some automatic brightness adaptation and some corresponding automatic color adjustments, as part of brightness adaptation. The challenge of computer monitors is not solely a question of screen brightness, but rather is more complicated, including issues created by color sensing and color perception, as the conditions under which the screen is being used and viewed change. What is needed is a means of enabling a computer or other display screen device to adapt the electronic visual display, taking into account the conditions the user is experiencing at the time of screen viewing.

Tone mapping has addressed some challenges associated with computer displays. However tone mapping primarily concerns itself with challenges associated with brightness perception.

Device illumination characteristics do not alter as illumination changes during sunrise or sunset, for example. Because human perception of color is strongly affected by environmental factors such as changes in sunlight, the un-adapted color of display devices may jar and even strain human eyes. What is needed is the ability to manually or automatically adjust illumination characteristics of electronic displays where such adjustment corresponds to the illumination characteristics of the user's real-time environment.

Currently, electronic displays implement color correction according to standards. "CIE-1931" defined Kelvin color temperatures and these have been used for many years in software/hardware calibration solutions. The "sRGB" standard provides a way to display RGB colors and is the standard color space used on the Web. Brightness, or intensity, adjustment in displays is common, and brightness can be automatically or manually set in appliances of many types, from alarm clocks to microwave ovens to cameras to mobile phones. But brightness is only one feature of illumination, and display color is different than display brightness.

Current electronic display systems do not dynamically adjust a display's color based on ambient conditions. Most assume "fixed" room lighting and controlled conditions. Moreover, no account is taken for the changes in human perception of color and other lighting characteristics experienced in a twenty-four hour light cycle.

What is needed is a means to beneficially effect changes in light attributable to light emitting, projecting or reflective appliances and display devices. What is further needed is a system for automatically correcting display devices to correct for perception of color in a variety of environmental illumination conditions.

BRIEF SUMMARY OF THE INVENTION

The invention satisfies at least all of the aforementioned unmet needs. The invention provides a system and method useful for the dynamic and automatic adjustment of color displays based on environment, including location, time of day, observed conditions, and user preference. The invention provides for sensor input to a system utilizing hardware and computer implementable instructions to dynamically adjust color of electronic displays. The invention further provides that such color adjustment affects the entire screen of the display and coincides with user experienced illumination changes, so that user visual perception of display color is accommodated.

The invention provides a framework for adjusting displays to be "scene adaptive" or otherwise adaptive to the visual environment or visual preferences of the display viewer. The invention enables dynamic and automatic adjustments the display of color to be appropriate to a location or situation. The invention provides for automatic adjustment of displays, and adjustment of signals to displays, where such adjustments are made in consideration of the environment in which the display is viewed. In the preferred embodiment, environmental data is input by means of one or more sensor devices. The invention provides for monitoring a set of sensors, and automatically adjusting the viewer's display based on some pre-determined set of rules.

Data from other sources, including but not limited to geo-positional data, imaging devices such as, for example cameras, as well as a variety of sensor types may also be used. In one embodiment, a system according to the invention provides automatic display adjustments so that display colors adjust according to time of day, becoming warmer after dark, to simulate indoor lighting, and cooler ("daylight-like") during the day, to match daylight. Other embodiments include dynamic and automatic adjustments as a function or input to the system, including user preference input.

Based on these real-world inputs and user-provided preferences, the system automatically adjusts the color display to be appropriate to a location or situation, without manual input being required at the time of the change.

The invention further provides a means to automatically and dynamically direct display characteristics to accommodate user aesthetic preferences, and, in some embodiments, health preferences.

Automatic adjustments to a display according to the invention may include adjusting display properties in a manner similar to the corrections provided by ICC/ICM. Methods may include adjusting color via a look-up table, adjusting brightness by means of power management, using 3-D textures, or using pixel-shaders or dedicated hardware to implement advanced color-correction modes such as those provided by ICC/ICM. One such approach, for example, is providing a 4×3 matrix or 3-D texture to simulate XYZ-space transforms in display hardware, instead of using a more common lookup table.

It can be appreciated that the invention may be implemented with a combination of hardware and software, and may include any of a number of modes of user preference input modes including speech, manual entry, and the like. Moreover, input from sensors useful in calibration may be in any of a wide range of forms, such as web-cams, linked mobile devices, et cetera. Moreover, adaptive color transform according to the invention may occur at the time of content generation (via a Web application server), at the broadcast level (e.g. via a cable head end or proxy server), local level (e.g. within an application by modifying content), User profile level (e.g. operating system software and hardware), hardware level (e.g. video card, pixel shaders, or look-up table (LUT), or light source level (e.g. by adjusting mixtures of RGB LEDs, and multiple white LED). Furthermore, the invention provides for inhibition of more than a single transform, in the event that a plurality of color transform inputs occurs in a signal chain. Thus, the invention provides a color transform in at least one target device (e.g. User display to be adapted) that optimizes the display for that User, and is appropriate for User environment. This is especially useful as a User may be viewing content via the display over time changes and geolocation changes. Moreover, viewed content may vary, including, for example, HTML pages, videos, pdfs, or book reader applications of various sorts.

The invention further provides a means to smoothly interpolate between display modes or states so as to automatically generate displays for aesthetic ambiance or health-related effect. Color and dark adaption may require that colors or intensities change slowly (e.g., over 60 seconds) in order not to be jarring to the viewer. Ambiance, for example, can be in the mimicking of a candle flame or other sensory-pleasing effect. Health oriented light emission modes can be, for example, an adjunct to sleep hygiene protocols, seasonal mood syndromes, or any other user specific preference.

DETAILED DESCRIPTION OF THE PREFERRED EMBODIMENT

Figure 1:
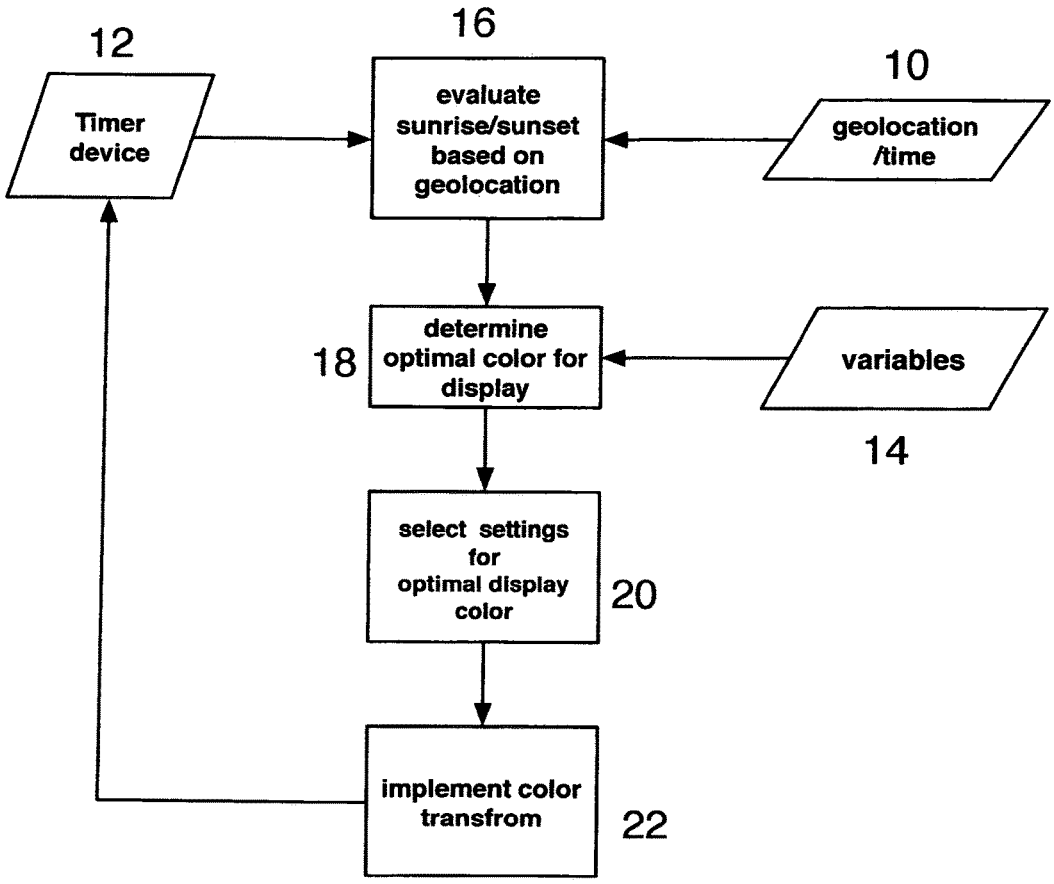
FIG. 1 illustrates an embodiment of the inventive method.

Introductory notes. Definitions are provided as an aid to understanding the invention taught herein.

"Color temperature," means a set of well-known color management techniques (CIE-1931). In one embodiment, the invention employs a subset of color correction functions known to simulate ambient light. A variety of techniques for using color correction functions may be employed, including: (a) conforming to the Kelvin blackbody colors, examples including an industry-standard D65 calibration for daylight with correlated color temperature 6500K, "tungsten" lighting at 2700K, "halogen" at 3400K, etc., and (b) by using direct observation of a scene's RGB colors to adjust lighting. It can be appreciated that other approaches fall within the scope of the invention as claimed herein.

"Hardware color lookup table" RGB correction means a subset of a color management system implemented by display hardware. While more advanced transforms (for example, techniques based on the CIE XYZ color space) are known, such techniques are not commonly implemented in display hardware today.

"Display hardware", also referred to herein as "display device", means a programmable grid of pixels or emissive or reflective sites, usually comprising R, G, and B in some combination. Examples include computer screens, cell phones, televisions, appliances (such as refrigerator screens), e-paper, digital picture frames, billboards, and lighting installations (for example, LED-based colored lighting).

Sensor, as used herein, means any input operable to communicate some condition to the system. As used herein, one or more sensors could be communicative regarding any or all of the following examples: the time of day, the user's location (determined manually or by devices such as GPS), a camera, a temperature gauge, a web-cam, a weather service provided via the Internet, user activity and task (for example, using applications associated with work as opposed to leisure.)

The invention provides means for automatically adjusting color temperature (modifying colors that are emitted or displayed) for a light-emitting or reflective display, based on any of a variety attributes, either singly or in combination. Some examples are listed below.

A system according to the invention may adjust color temperature according to time of day. Time of day color adjustment may be implemented in accord with user-provided instructions. For example, User input instructions to change display illumination based on User routine, such as transitioning from computer user for work activities, to computer user for recreation. The user input of data, such as "work ends at 7 p.m. daily" is stored, and display device, such as computer monitor, automatically alters color characteristics at 7 p.m. Other factors concerning how the display colors alter are further discussed below.

In addition to user schedule data, a system according to the invention may incorporate data corresponding to User environment. The inventive system may use geo-location data, whether by manual entry, as derived from information such as zip code, or as supplied to system by GPS-like inputs. With geo-location data input, the system may incorporate environmental illumination conditions such as sunrise or sunset into display adjustments. It can be appreciated that specific variations may further include daily weather conditions, such as overcast, cloudy, rainy, and the like, obtained from any of a variety of data sources, to similarly adjust display color. An alternate embodiment of the inventive system may incorporate input from real-world conditions by means of web-cam or other sensor, and mapping sensor detected intensity to probable color temperature, or mapping sensor detected color to probable color temperature. Mapping may be accomplished by a variety of approaches, including use of a sample of a known color target.

Further, the inventive system provides for automatic adjustment of display brightness as well as color temperature. User preferences may be also used in scaling and otherwise influencing display changes.

In one embodiment, a system according to the invention implements changes in display hardware by adjusting color temperature via a lookup table (e.g., to implement a "diagonal matrix" correction). Moreover, adjusting brightness may be accomplished by means of power management techniques, such as are used, for example, to dim a display in computer or cell phone display screens.

Alternatively, advanced "pixel shaders" or dedicated hardware may be used to implement advanced color correction models, such as those provided by ICC/ICM. In one implementation, rather than a simple diagonal look up matrix, a 4×3 matrix is provided to simulate XYZ-space transforms in display hardware.

It can be appreciated that in any of the foregoing examples, software may be used alone or in combination with hardware components to effect changes in the display hardware. Moreover, any changes in display hardware may be accomplished using smooth interpolation between states, in order to create changes in a visually pleasing manner.

The invention provides for using display hardware to create ambient lighting. In one embodiment, the invention provides for setting a display device to a single color or a textured set of colors in order to create an ambient effect. Alternatively, a display may be set to produce an ambient "look" such as, for example, a candle flickering. Such animated display may be selected to reflect colors recorded in real world or imagined scenes.

Herein below is an example of an implementation of the invention is provided in detail. The example is that of automatically adapting a display, such as computer monitor, to time of day based on geo-location of the display. It can be appreciated that a system according to the invention includes, in conjunction with a display device, some processing capability, some memory capability and some computer implementable instructions capable of being implemented so as to effect a perceptible change in the display device. Connectivity between elements of the system may be by means of hardwiring, wireless or remote, or any combination. Data input may be by means of connectivity via a network, including but not limited to the Internet.

Using a desktop or laptop computer display as an example of the display to be adapted, an example according to a preferred embodiment of the invention, depicted in FIG. 1, and which is described as follows:

Sensors or data input as to geolocation and time 10, in conjunction with a timer device 12, enable determination of time of day or sunrise/sunset 16 at or near the location of the display to be adapted. Additional data input such as weather, ambient lighting, and user data, variables 14, are also processed, and a determination of target or ideal color conditions for the display is made [i.e. determine optimal color for display 18]. Based upon such determination of target display colors, a set of new color settings is selected [i.e. select settings for optimal display color] 20. Then, based on the selected color settings, hardware look up tables, power management and pixel shaders are set to implement color transforms 22 in the display to be adapted. Additionally, smooth interpolations can be effected between initial state of the display to be adjusted and the target state, such that the transition to the target state is visually pleasing. The resulting output is a display using colors consistent with the determination of the ideal color for the display. The ideal display is a display optimized for the target device as determined to be appropriate for User criteria.

Pseudocode. A timer device generates periodic events information and such data generation from the timer device is input according to the invention. To ascertain sunrise or sunset, the following code is executed periodically by a background process, perhaps once per second:

```
AdjustColor( ): timer(1 hz)
{
  latlong gps:=WhereAmI( );
  timezone tz=TimeZone( );
  time now:=TimeNow( );
  time rise:=Sunrise(tz, gps); // as provided by a table
  time set:=Sunset(tz, gps); // as provided by a table
  if (now <rise) {
  SetColor(pref.indoor); // e.g., 2700K
  } else if (now <set) {
  SetColor(pref.outdoor); // e.g., 6500K
  } else {
  SetColor(pref.indoor); // again 2700K
  }
}
```

In some instances, only the geolocation and "local time" are needed, with "local time" approximating longitude adequately (within ½ hour). Actual latitude and longitude, it can be appreciated, in many cases enable more precise calculations.

Determining, selecting and implementing color adjustments in display devices can be appreciated by one of average skill in current display technology. Kelvin to sRGB tables are readily available on the Web. See, for example, http://www.vendian.org/mncharity/dir3/blackbody/. And computer operating systems provide calls to set programmable display lookups and to employ common display profiles such as those defined by ICC.

Below follows a brief example of how to approximate color temperature using existing display hardware.

```
SetColor(kelvin)
{
  // create a table for an 8-bit sRGB display color
    rgb=KelvinTosRGB(Kelvin);
  uint16 gammaramp[768];
  gammaramp[i=0 . . . 255]:=rgb.r*i;
```

```
gammaramp[i=256 . . . 511]:=rgb.g*(i−256);
gammaramp[i=512 . . . 767]:=rgb.b*(i−512);
SetGammaRamp (gammaramp);
}
```

This lookup achieves a "diagonal matrix" correction of color. Better results can be achieved if hardware supports a 4×3 matrix or a 3-D texture, in which case a matrix would be provided instead of an RGB "white" value, and the matrix would be provided to hardware to do corrections directly.

Figure 2:
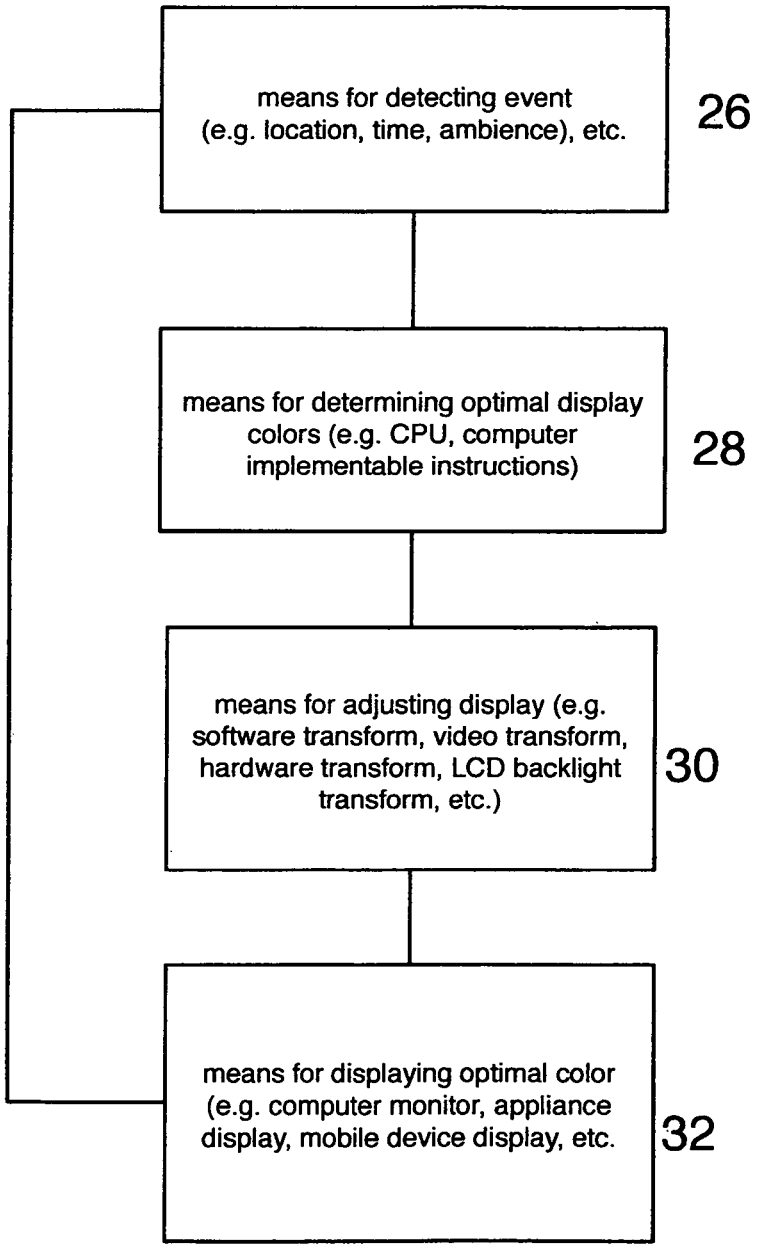
FIG. 2 depicts a generalized system according to the present invention.

FIG. 2 depicts a generalized system 24 performing according to the invention taught herein. Such a system includes a means for detecting an event 26 (e.g. location. time, ambient conditions, etc.) germane to the display of interest; a means for determining optimal display colors 28 for the target display (e.g. CPU, computer implementable instructions operable to calculate ideal display using parametric analysis); means for adjusting the display 30 (e.g. using any of a software transform, a video transform, a hardware transform, or an LCD/backlight transform); and a means for displaying optimal color 32 (e.g. any emissive, projective or reflective display, such as a computer monitor, appliance display, appliance, mobile device display, etc.).

In some embodiments, the means for adjusting display includes an inhibition of more than one transform input. Sources of transform input can be any of application server, proxy server, cable head end, application and content, operating system, videocard, pixel shaders, look-up table, and device backlight. Thus, the invention provides for harmonizing and otherwise controlling inadvertent or undesired additive effects of multiple transforms that could otherwise be input at different levels of the content intended to be displayed on the display device.

The system's means for determining optimal display characteristics further includes a parametric analysis of type of content to be displayed on the display to be adjusted. Types of content include, but is not limited to HTML, video, pdf, e-books, or any combinations thereof.

The examples provided herein are intended to be illustrative, and do not limit the scope of the invention. It can be appreciated that the invention has many applications and advantages. Healthful benefits include reduction of eyestrain, as when, for example, using a portable electronic reading device, mobile device or computer monitor, decrease of insomnia for late-night TV watchers or computer users, aiding user attention (stimulation) or stress-reduction (calming), reducing bright adaptation to make other objects more visible (for example, when using handheld devices while driving). Moreover, artistic or creative applications are myriad. Altering color display such as digital picture frames to vary corresponding to lighting conditions such as sunrise or sunset is one example.

Moreover, the invention enables transforming broadcast or unicast content (for instance, when the approximate location and time zone of the viewer are known. Technologies associated with "geo-ip" and HTML5 geolocation can be used to establish a user's location. It can be appreciated that a cable TV provider could perform color correction according to the invention at the head end of a local broadcast, to name just one of many possible implementations within the scope of the claims.

We claim:

1. A method for automatically correcting a color temperature of an electronic visual display, said method comprising:

determining, for the electronic visual display, time of day in a vicinity of the electronic visual display;

determining target color conditions for said electronic visual display;

adjusting color correction for said electronic visual display by selecting a color temperature for the electronic visual display that is based on the time of day in the vicinity of the electronic visual display, and that corresponds to the determined target color conditions;

setting at least one or more graphics sub-systems to produce color transforms through the one or more graphics sub-systems to correct colors consistent with said selected color settings for said electronic visual display; and changing from an initial state of said electronic visual display to the selected color temperature for said electronic visual display, wherein the adjusted color correction is selected to have warmer color temperature later in the evening than during the day, such that said electronic visual display automatically displays adjusted colors according to said determined target color conditions, wherein the target color conditions are determined automatically by a background process of a computing device that has the electronic visual display, the background process programmed to adjust color correction to be responsive to current ambient conditions in a location around the display.

2. The method as in claim 1 wherein said step of determining target color conditions for said electronic visual display includes mapping intensity of color received by an imaging device to probable color temperature.

3. The method as in claim 1 wherein said step of determining target color conditions for said electronic visual display includes interpreting data that describes a user's location, lighting environment, daily schedule, and visual preferences.

4. The method as in claim 1 further including adjusting display brightness of the electronic visual display in coordination with changing to the selected color temperature, such that, with respect to the selected target color setting for the electronic visual display, cooler target color settings correspond to more brightness and warmer color settings correspond to less brightness, such that, as a default, a dimmer target display becomes warmer and a brighter target display becomes cooler as a consequence of adjustment.

5. The method as in claim 1 wherein said target color temperature corresponds to display of modified content, where said content is modified at or by any of: a head end of a broadcast, an application server, a proxy server, and a client application.

6. The method of claim 1, wherein the changing to the selected color temperature is made so that the electronic visual display simulates indoor light at night and simulates sunlight during day.

7. The method of claim 1, wherein the changing to the selected color temperature comprises smoothly interpolating from the initial state of the electronic visual display.

8. The method of claim 1, wherein the changing to the selected color temperature reduces an insomnia-causing effect by the electronic visual display.

9. The method of claim 1, wherein the changing to the selected color temperature reduces an insomnia-causing effect by the electronic visual display.

10. The method of claim 1, wherein the color transforms are performed by a diagonal matrix via a look-up table.

11. The method of claim 1, wherein a time at which color correction settings are adjusted changes according to a user schedule.

12. The method of claim 1, wherein a time at which color correction settings are adjusted changes according to a time of sunrise and a time of sunset.

13. A system for color temperature modification in electronic visual display devices, said system comprising:

a color-adjustable electronic visual display;

a processor for providing information to the electronic visual display for generating color graphical information on the electronic visual display;

memory in communication with the processor and storing instructions that, when executed by the processor, perform operations comprising:

detecting an event, where said event detection includes data collection pertinent to the event from one or more data sources that include a clock or timer;

determining ideal display characteristics for said electronic visual display, wherein said determining includes performing mapping or parametric analysis of data collected from at least one data source related to said detected event;

generating at least one color temperature setting for said electronic visual display such that the generated color temperature setting corresponds to said ideal display characteristics; and adjusting said electronic visual display to said color temperature setting, wherein the adjusting comprises changing from an initial state to said color setting so that the electronic visual display provides warmer colors at nighttime compared to daytime, wherein the color temperature setting is generated automatically by a background process programmed to adjust color correction settings to be responsive to ambient conditions in a location around the display.

14. The system of claim 13 wherein content to be transformed as part of adjusting the visual display includes at least a background web page and a graphic image/picture.

15. The system of claim 13 wherein said adjusting the electronic visual display includes turning off the adjusting when photo editing is being performed on the display.

16. The system of claim 13 wherein adjusting the visual display comprises transforming different types of content to be displayed on said electronic visual display using the ideal display characteristics, the different types of content including video content.

17. The system of claim 13 wherein adjusting the visual display comprises transforming different types of content to be displayed on said electronic visual display using the ideal display characteristics, the different types of content including digital, electronic book content.

18. A method for automatically modifying color temperatures displayed by an electronic visual display, the method comprising:

determining, by a background process executing on a computing device, a time of day for the computing device that provides data for display on the electronic visual display;

identifying color settings of information to be displayed on the electronic visual display;

determining, by the background process executing on the computing device, target color conditions for the electronic visual display, the determined target color conditions responsive to ambient light conditions to produce a color temperature for the ambient light conditions; and adjusting the identified color settings to correct color displayed on the computing device according to the determined target color conditions, wherein correcting the color displayed on the computing device comprises correcting colors of content that has been provided for display, wherein the adjusting comprises changing from an initial state to said target color conditions so that the visual display provides warmer colors at nighttime and cooler colors in daytime.

19. The method of claim 18, wherein the color temperature produced for the ambient light conditions is directed to accommodating user visual perception of display color.

20. The method of claim 18, where determining target color conditions for the electronic display further comprises identifying daily weather conditions obtained from a data source.

21. The method of claim 1, further comprising determining a schedule that is particular to a user of the electronic visual display and adjusting color correction settings for said electronic visual display by selecting a color temperature for the display that is based on the schedule particular to the user.

* * * * *